US005701687A

United States Patent [19]

Schmidt et al.

[11] Patent Number: 5,701,687

[45] Date of Patent: Dec. 30, 1997

[54] THRUST PRODUCING SOLE AND HEEL STRUCTURE WITH INTERIOR AND EXTERIOR FLUID FILLED POCKETS

[75] Inventors: Karl M. Schmidt, Woodside; Stuart E. Jenkins, Thousand Oaks, both of Calif.; Harry W. Edwards, Barrington, Ill.

[73] Assignee: Energaire Corporation, Pebble Beach, Calif.

[21] Appl. No.: 581,942

[22] Filed: Jan. 2, 1996

[51] Int. Cl.[6] ..... A43B 13/20

[52] U.S. Cl. ..... 36/29; 36/3 B

[58] Field of Search ..... 36/114, 28, 29, 36/25 R, 30 R, 3 R, 3 B

[56] References Cited

U.S. PATENT DOCUMENTS

| | | | |
|---|---|---|---|
| 4,237,625 | 12/1980 | Cole et al. | 36/28 |
| 4,358,902 | 11/1982 | Cole et al. | 36/28 |
| 4,414,760 | 11/1983 | Faiella | 36/29 |
| 4,856,208 | 8/1989 | Zaccaro | 36/29 |
| 4,936,030 | 6/1990 | Rennex | 36/28 |
| 5,067,255 | 11/1991 | Hutcheson | 36/43 |
| 5,084,987 | 2/1992 | Flemming | 36/28 |
| 5,195,254 | 3/1993 | Tyng | 36/3 R |
| 5,195,257 | 3/1993 | Holcomb et al. | 36/28 |
| 5,245,766 | 9/1993 | Warren | 36/29 |
| 5,313,717 | 5/1994 | Allen et al. | 36/28 |
| 5,325,614 | 7/1994 | Rosen | 36/97 |
| 5,363,570 | 11/1994 | Allen et al. | 36/28 |
| 5,365,678 | 11/1994 | Shibata | 36/29 |
| 5,375,346 | 12/1994 | Cole et al. | 36/29 |
| 5,384,977 | 1/1995 | Chee | 36/28 |
| 5,416,986 | 5/1995 | Cole et al. | 36/29 |

FOREIGN PATENT DOCUMENTS

| | | |
|---|---|---|
| 338266 | 11/1930 | United Kingdom . |
| 2114425 | 8/1983 | United Kingdom . |

*Primary Examiner*—B. Dayoan

*Attorney, Agent, or Firm*—Emrich & Dithmar

[57] ABSTRACT

A shoe sole and heel structure is provided. The structure includes an outsole having interior and exterior surfaces and a bulge projecting from the exterior surface, the bulge defining a cavity opening at the interior surface, and a midsole overlying the outsole, the midsole having an outsole-facing surface and a foot-facing surface. The structure also includes a hermetic attachment between the interior surface of the outsole and the outsole-facing surface of the midsole to form a member having a sole portion and a heel portion, wherein the cavity cooperates with a portion of the midsole to define a pocket. The structure further includes an expandable bladder, a tube defining a passageway in the member providing fluid communication between the pocket and the bladder, and fluid permanently disposed in the space jointly defined by the pocket, the bladder and the passageway, whereby at rest a foot in a shoe incorporating the structure is cushioned comfortably on the fluid in the pocket and bladder. Either the pocket or the bladder can be disposed in sole portion with the other disposed in the heel portion.

22 Claims, 6 Drawing Sheets

THRUST PRODUCING SOLE AND HEEL STRUCTURE WITH INTERIOR AND EXTERIOR FLUID FILLED POCKETS

BACKGROUND OF THE INVENTION

1. Field of the Invention

The present invention relates to shoe sole and heel constructions and, in particular, to such constructions with fluid-filled pockets for providing cushioning and forward thrust.

2. Description of the Prior Art

Various types of shoe sole and heel constructions having fluid-containing cavities have heretofore been provided, such constructions being disclosed, for example, in U.S. Pat. Nos. 4,237,625, 4,358,902, 4,577,417, 5,375,346 and 5,416,986.

These patents disclose a molded outer sole and heel member which has downwardly projecting heel and metatarsal bulges molded therein to define cavities and a passageway extending between the cavities. Air or other fluid, at atmospheric pressure, moves back and forth between the cavities through the passageway during movement of a person wearing the shoe.

These prior sole and heel structures have provided cushioning for the user's foot and have also provided forward thrust which facilitates walking or running movements. These bulges usually, however, prevent the member from having an exterior flat portion in the heel and sole portion of the outsole, which limits the versatility of the shoe. Additionally, these bulges can tend to produce a lateral instability in the shoe, causing the shoe to tilt laterally inwardly or outwardly in use, resulting in pronation of the wearer's feet. For example, in walking and jogging gaits, wherein the initial shoe strike is at the heel, the initial point of impact is typically at the laterally outer side of the heel, i.e., at the right side of the right heel and the left side of the left heel. Thus, there is a tendency for the fluid in the heel cavity to move from side to side, as well as forwardly toward the metatarsal cavity. Though this instability has been alleviated by providing downwardly projecting stabilizing structures adjacent to the bulges, or by reconfiguring the fluid flow and bulge configurations, shoes incorporating these prior structures do not provide a flat sole or heel and, therefore, cannot be used for all applications.

Other shoe sole and heel structures include internal interconnected air cavities in the midsole of a shoe. These structures suffer from, among other things, poor fluid flow from one cavity to another, thereby decreasing the cushioning efficiency of each cavity.

SUMMARY OF THE INVENTION

It is a general object of the invention to provide an improved shoe sole and heel structure which avoids the disadvantages of prior structures while affording additional structural and operational advantages.

An important feature of the invention is the provision of a shoe sole and heel structure with fluid-filled pockets which is of relatively simple and economical construction.

A still further feature of the invention of a shoe sole and heel structure of the type set forth which has a substantially flat external portion which provides improved lateral stability.

Yet another important feature of the invention is the provision of a shoe sole and heel structure of the type which includes fluid-filled pockets and communicating passageways therebetween, which optimizes the cushioning effect of the fluid.

These and other features of the invention are attained by providing a shoe sole and heel construction including a structure having an exterior ground-contacting surface and a bulge projecting from the exterior ground-contacting surface, the bulge defining a first pocket. The construction further includes an expandable bladder defining a second pocket and disposed in the structure above the exterior ground-contacting surface to avoid contact with the ground in use. The structure includes a portion defining a passageway providing fluid communication between the pockets. Fluid is permanently disposed in the space Jointly defined by the pockets and the passageway, whereby at rest a foot in a shoe incorporating the structure is cushioned comfortably on the fluid in the first and second pockets.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DETAILED DESCRIPTION OF THE PREFERRED EMBODIMENTS

Figure 3:
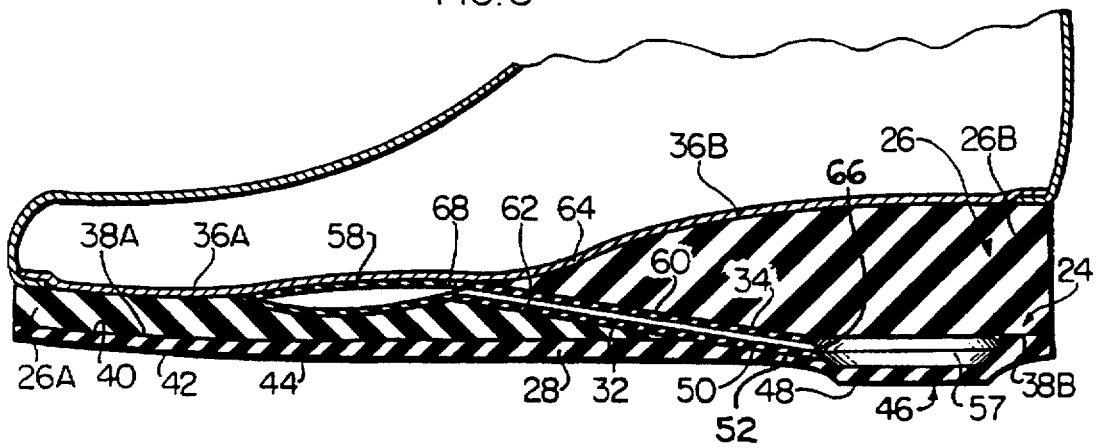
FIG. 3 is a fragmentary, sectional view taken generally along the line 3—3 of FIG. 2.
Figure 4:
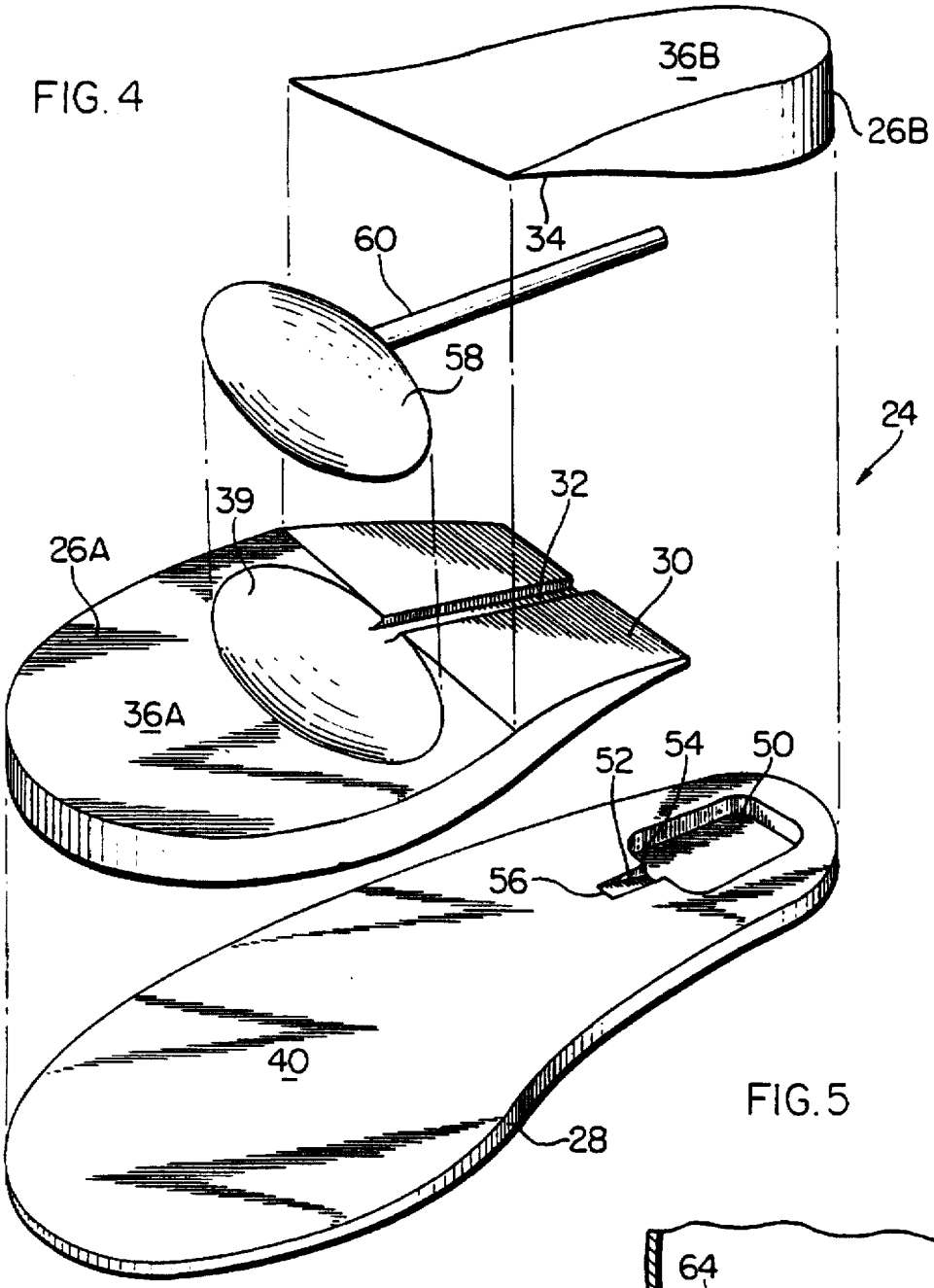
FIG. 4 is an exploded, perspective view of the sole and heel structure of the shoe of FIG. 1.

As seen in FIGS. 1–5, a shoe 20 having a conventional upper or last 22 is provided. The shoe 20 also includes an outer sole and heel structure 24. The structure 24 includes a midsole 26 overlying an outsole 28. As seen in FIG. 4, the midsole 26 is of two-piece construction and includes a sole portion 26A and a heel portion 26B. The sole portion 26A is located under the sole of a wearer's foot and has an inclined surface 30 and a generally rectangular shaped channel cavity 32 opening at the inclined surface 30.

Figure 1:
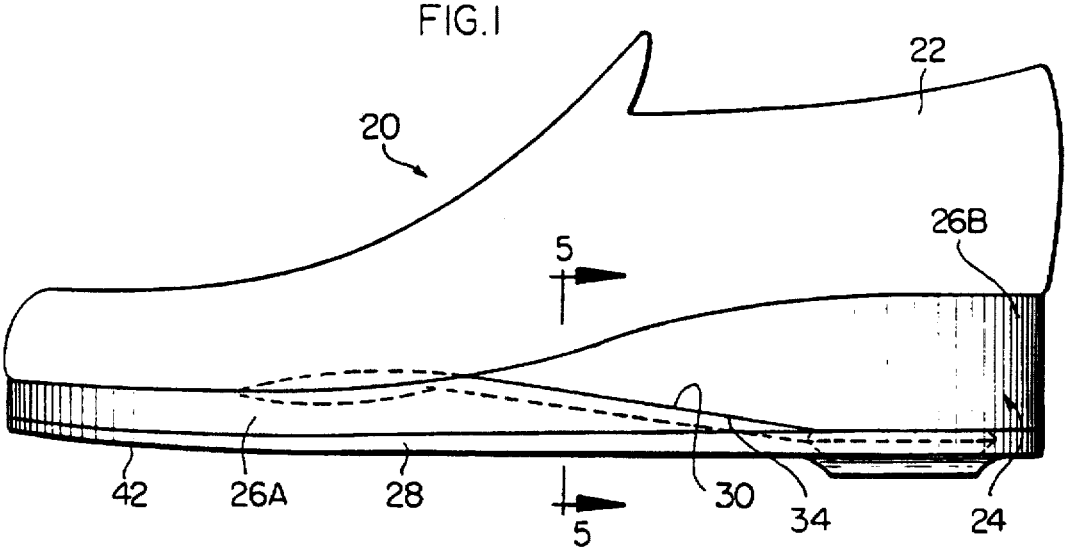
FIG. 1 is a side elevational view of a shoe of the present invention.
Figure 2:
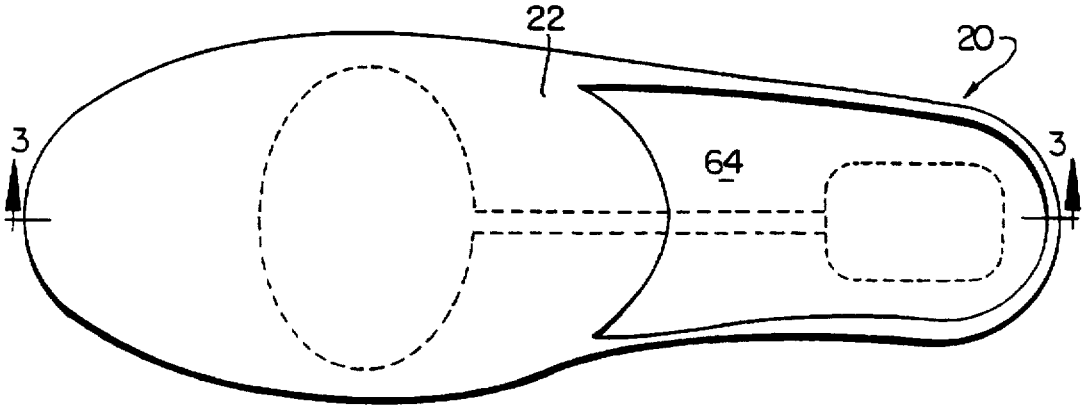
FIG. 2 is a top plan view of the shoe of FIG. 1.

The heel portion 26B, as seen in FIG. 3, is located under the heel of a wearer's foot and has an inclined surface 34 mateable with, adhesively attached to and overlying the inclined surface 30 of the sole portion 26A. The sole portion 26A and the heel portion 26B, respectively have, as seen in FIGS. 1 and 3, foot facing surfaces 36A, 36B and outsole facing surfaces 38A, 38B disposed above the outsole 28. The sole portion 26A also has a generally oval-shaped cavity 39 opening at the foot facing surface 36A and communicating with the channel cavity 32.

As discussed in greater detail below, the sole portion 26A and the heel portion 26B of midsole 26 may each be a molded piece made of a light-weight, generally non-porous material which prevents the transmission of fluids, such as air, therethrough. Useful midsole materials include molded polyurethane and EVA.

The outsole 28 is an elongated, thin member of one-piece molded construction, preferably made of a highly flexible, highly wear-resistant material, such as rubber. A very useful rubber is a rubber sold under the brand name INDY 500 and made by Goodyear Tire and Rubber Company.

The outsole 28 has an interior surface 40 which faces the midsole 26 and an exterior surface 42 which is subject to engagement with the pavement or other underlying support surface, which will hereinafter be referred to as the "ground". The outsole 28 also has a substantially flat sole portion 44 located under the sole portion 26A of the midsole 26 and the sole of a wearer's foot and a heel portion 46 located under the heel portion 26B of the midsole 26 and the heel of the wearer's foot.

A heel bulge 48 is molded into the heel portion 46 and projects downwardly from the exterior surface 42 and underlies the heel area of a wearer's foot for which the sole and heel structure 24 is sized. The heel bulge 48 defines a rectangular-shaped heel cavity 50 which opens upwardly at the interior surface 40.

A channel cavity 52 is also molded into the outsole 28 and opens upwardly at the interior surface 40. The channel cavity 52 extends from a first end 54 (which opens into the rectangular-shaped heel cavity 50) to a second end 56 (which opens into the channel cavity 32 of the midsole 26).

An adhesive is disposed between the interior surface 40 of the outsole 28 and the downwardly-facing surfaces 38A, 38B of the sole portion 26A and the heel portion 26B of the midsole 26 for fixedly securing the midsole 26 and outsole 28 together in a fluid-tight manner. In this regard, as discussed above, it will be appreciated that the midsole 26 and the outsole 28 are formed of fluid-impermeable materials and are also resilient to accommodate flexing during use of the shoe 20. Thus, the heel portion 26B of the midsole 26 and the outsole 28 cooperate to hermetically seal and form a heel pocket 57, permanently trapping air or other fluid at atmospheric or other pressure therein.

The outer sole and heel structure 24 also includes a bladder 58 and a hollow tube 60 defining a restricted passageway 62. The tube 60 and bladder 58, as seen in FIG. 4, can be a one-piece molded construction and can be constructed of a rubber-type material which is expandable and impervious to fluid. The bladder 58 and tube 60 have air, or other fluid, at atmospheric or other pressure, disposed therein.

As seen in FIG. 3, the bladder 58 is disposed in the oval-shaped cavity 39 of the sole portion 26A directly under a sock-liner 64 (and a wearer's foot). The tube 60 is disposed in and adhesively attached to the channel cavity 32 of the heel portion 26B of the midsole 26 and the channel cavity 52 of the outsole 28.

As best seen in FIG. 3, restricted passageway 62 has a first opening 66 which opens into the heel pocket 57 and a second opening 68 which opens into the bladder 58. The restricted passageway 62 thereby allows the heel pocket 57 to fluidly communicate with the bladder 58.

In use, the air in pocket 57 and bladder 58 provide a cushioning effect. In walking and running, the heel bulge 48 of the outsole 28 first comes in contact with the ground and causes the air to be compressed in the heel pocket 57 and forced through the passageway 62 into the bladder 58, which then expands. As the heel portion lifts off the ground and the sole portion 44 of the outsole 28 contacts the ground, the force of the ground contacting the sole portion 44 of the outsole 28 under the bladder 58 and the force of the wearer's foot on the sock liner 64 above the bladder 58 and the elastic nature of the bladder 58 trying to return to its non-expanded state causes the air in bladder 58 to be forced through passageway 62 back into heel pocket 57 to give a lifting effect. Thus in walking and running, the air moves back and forth between the pocket 57 and bladder 58 through the passageway 62 to give an alternating lifting effect and provide thrust both at the metatarsal ball area and in the heel area that facilitates walking and running.

Figure 5:
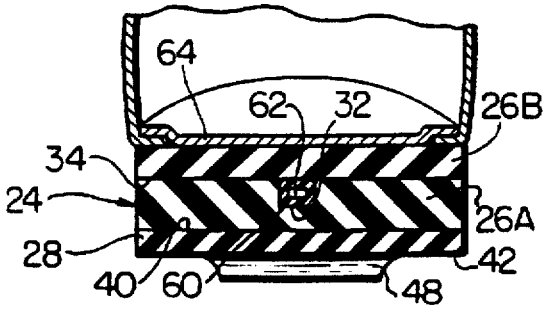
FIG. 5 is a fragmentary, sectional view taken generally along the line 5—5 of FIG. 1.

Though the tube 60 is usually constructed of the same material as the bladder 58 and is capable of expansion, the majority of the tube 60 is surrounded or encapsulated, as seen in FIGS. 3 and 5, by the channel cavity 32 of the sole portion 26A of the midsole 26, the channel cavity 52 of the outsole 28 and the inclined surface 34 of the heel portion 26B of the midsole 26. This encapsulation prevents the tube 60 from expanding, which would cause the volume of the passageway 62 to increase, thereby causing air to remain in the passageway 62 rather than in the bladder 58 and heel pocket 57, where it is needed.

Additionally, the inner diameter of the tube 60 is sized sufficiently small to provide proper fluid transfer between the bladder 58 and the heel pocket 57. Preferably, the inside diameter of the tube 60 is about 0.125 inches or less.

The volume of the expanded bladder 58 is usually smaller than the volume of the heel pocket 57. Since, unlike the heel pocket 57, no portion of the bladder 58 is ever in direct contact with the ground, less force is exerted on the bladder 58 than on the heel pocket 57 when they are, respectively compressed. Since the volume of the bladder 58 is smaller than that of the heel pocket 57, it is believed that its fluid pressure is higher when it is fully filled with fluid than is the pressure in the heel pocket 57 when it is fully filled. Since the bladder 58 is at higher pressure and is naturally trying to return to its non-expanded state, not as much force is required to be exerted on the bladder 58 to cause the fluid to quickly flow through restricted passageway 62 into heel pocket 57 to raise the desired alternate lifting and cushioning effect.

As best seen in FIGS. 1 and 3, since no portion of the bladder 58 projects from the exterior surface 42 of the outsole 28, the exterior surface 42 of the sole portion 44 of the outsole 28 is generally flat and planar. This planarity provides increased versatility as compared to a shoe which has a bulge (which forms a portion of a sole air pocket) which extends from the sole portion of an outsole. For example, spikes can be placed on the sole portion 44 of the outsole 28 for golf or baseball use.

As seen in FIGS. 6–10, an alternative embodiment of the present invention is illustrated. Unlike the embodiment shown in FIGS. 1–5, a bladder is disposed in the heel portion of an outer sole and heel member and a portion of a metatarsal pocket, rather than a heel pocket, contacts the ground.

Figure 6:
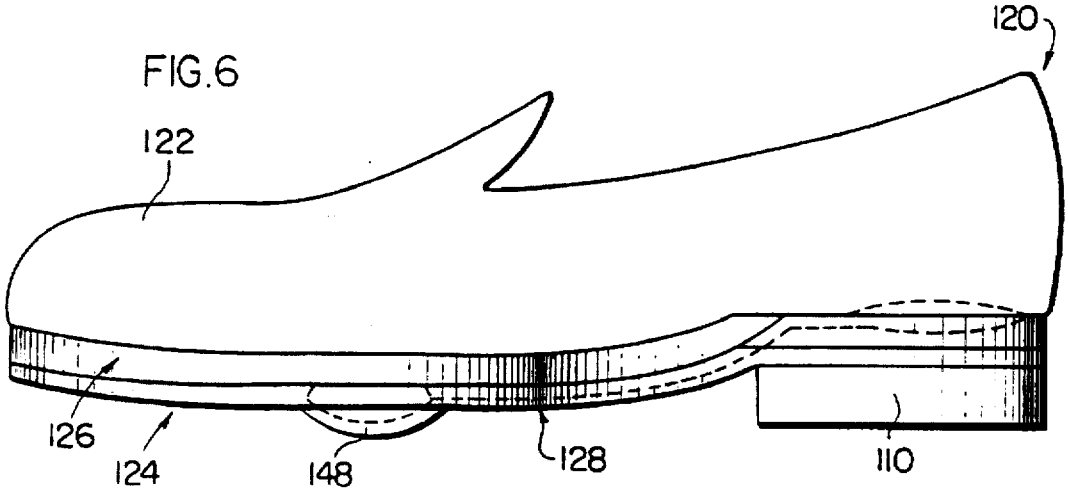
FIG. 6 is a side elevational view of a second shoe embodiment of the present invention.
Figure 7:
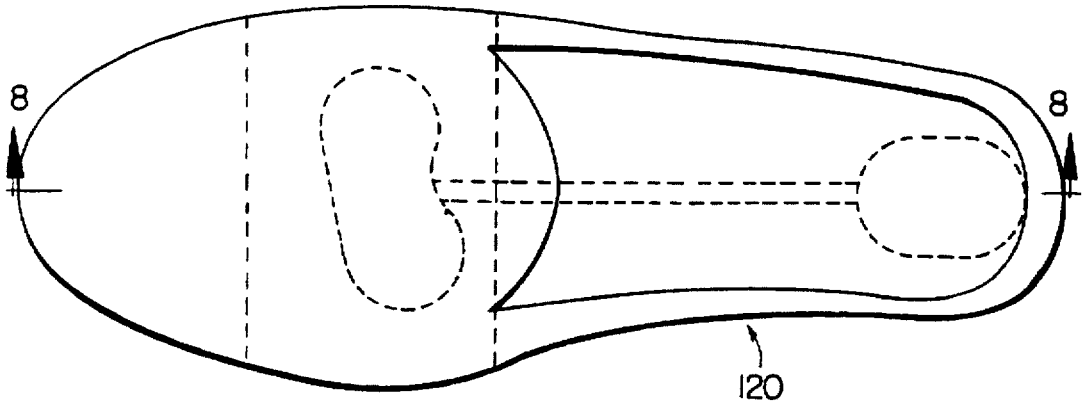
FIG. 7 is a top plan view of the shoe of FIG. 6.
Figure 8:
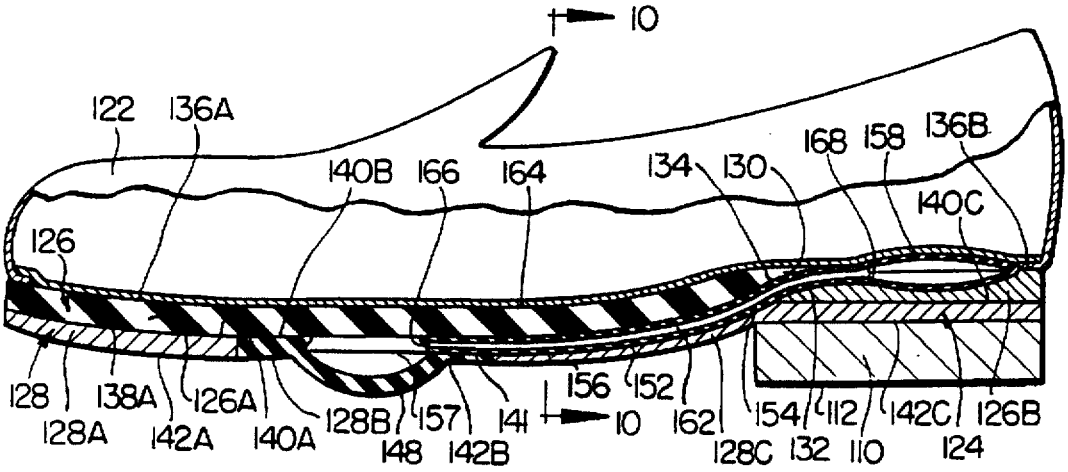
FIG. 8 is a side elevation view of the shoe of FIG. 7 taken partly in section generally along line 8—8 of FIG. 7.
Figure 9:
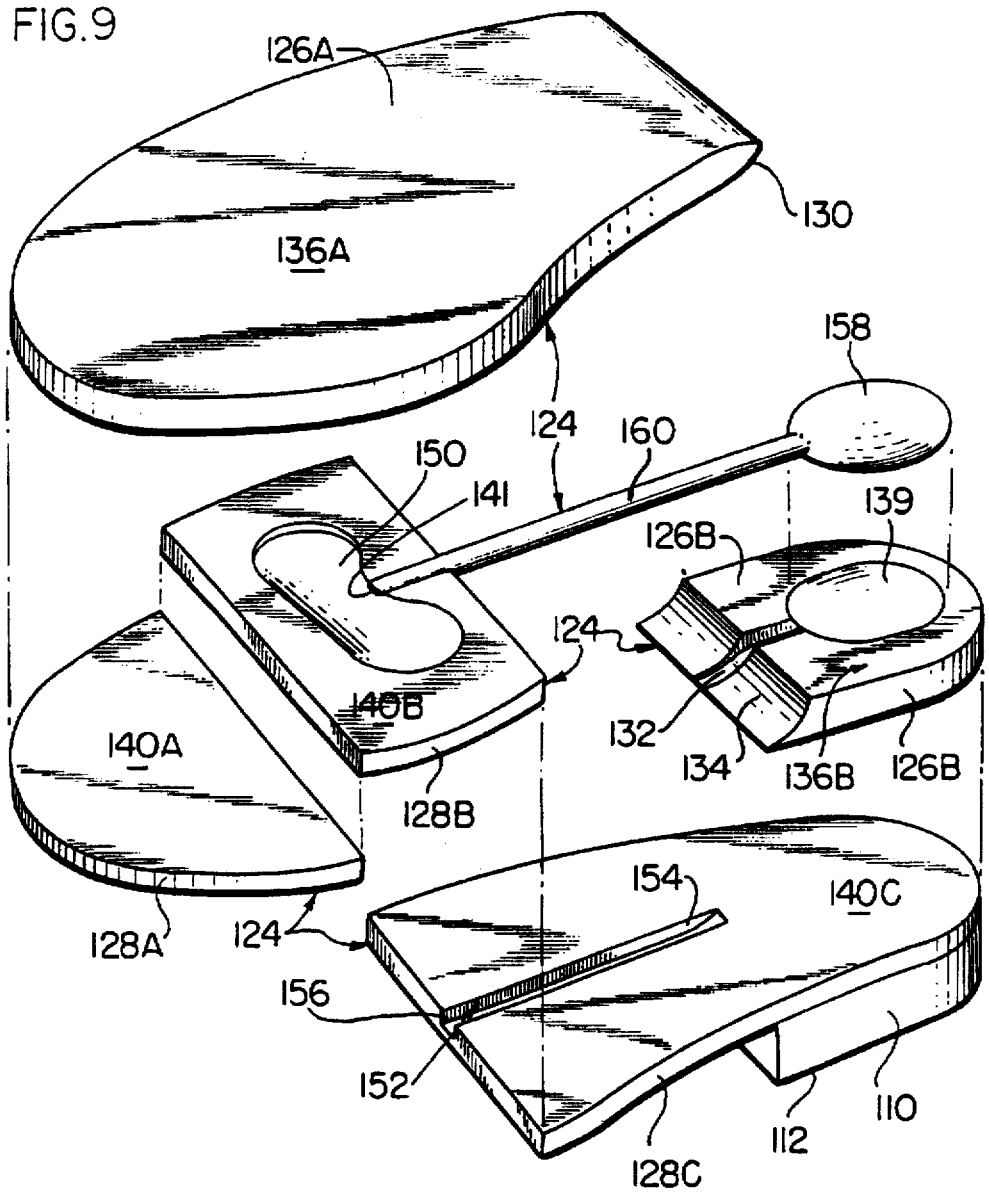
FIG. 9 is an exploded, perspective view of the sole and heel structure of the shoe of FIG. 6.
Figure 10:
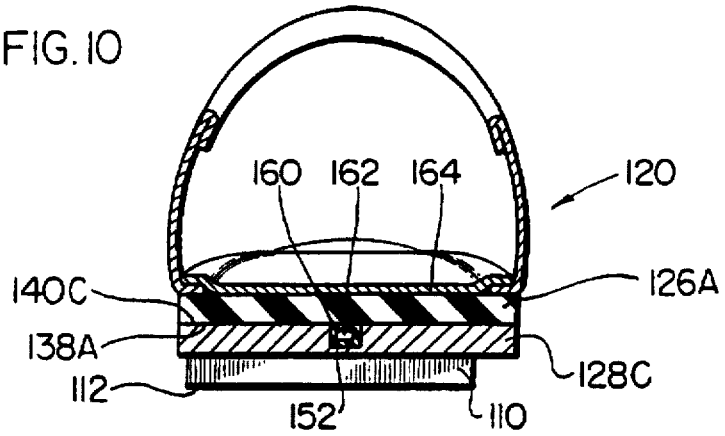
FIG. 10 is a sectional view taken generally along the line 10—10 of FIG. 8.

Referring to FIG. 6, there is illustrated a shoe 120 having a conventional upper portion or last 122. The shoe 120 also includes an outer sole and heel structure 124 which includes a two-piece midsole 126 overlying a three-piece outsole 128. Referring also to FIGS. 7–9, the midsole 126 has a sole portion 126A located under the sole of a wearer's foot and a heel portion 126B located under the heel of a wearer's foot. The sole portion 126A has an upwardly curved end surface 130. The heel portion 126B has a box-like channel cavity 132 and a curved end surface 134. The curved end surface 134 is mateable with, adhesively attached to and underlies the curved end surface 130 of the sole portion 126A. The sole portion 126A and the heel portion 126B, respectively, have foot facing surfaces 136A, 136B, which face a wearer's foot, and outsole facing surfaces 138A, 138B, which face the outsole 128. The sole portion 126A of the midsole 126 may be a molded piece made out of the same materials as the midsole 26 of FIGS. 1–5. As seen in FIGS. 8 and 9, the heel portion 126B of the midsole 126 includes an oval-shaped heel cavity 139 which opens upwardly at the foot-facing surface 136B and communicates with the channel cavity 132.

The outsole 128 includes a first sole portion 128A, a second sole portion 128B and a heel portion 128C. The first sole portion 128A and heel portion 128C can be made out of almost any material, including rubber or leather. The second sole portion 128B is a thin member of one-piece molded construction, preferably made of the same, highly flexible, highly wear-resistant material as the outsole 28 of FIGS. 1–5.

The first sole portion 128A, the second sole portion 128B and the heel portion 128C, respectively, have interior surfaces 140A–140C, which face the midsole 126, and exterior surfaces 142A–142C. The first and second sole portions 128A, 128B are located under the sole portion 126A of the midsole and the sole of a wearer's foot and a substantially flat portion of the heel portion 128C is located under the heel portion 126B of the midsole 126 and the heel of a wearer's foot.

A metatarsal bulge 148 is molded into the second sole portion 128B and projects downwardly from the exterior surface 142B. The metatarsal bulge 148 extends generally laterally across the second sole portion 128B and underlies the metatarsal ball area of a wearer's foot for which the sole and heel structure 124 is sized. The metatarsal bulge 148 defines a kidney-shaped metatarsal cavity 150 which opens upwardly at the interior surface 140B. The second sole portion 128B also includes a channel cavity 141 which opens upwardly at the interior surface 140B and communicates with the metatarsal cavity 150.

A channel cavity 152 is molded or cut into the heel portion 128C of the outsole 128 and opens upwardly at the interior surface 140C. The channel cavity 152, as seen in FIGS. 8–9, extends from a first end 154 which opens into the channel cavity 132 of the heel portion 126B of the midsole 126 to a second end 156 which opens into channel cavity 141 of the second sole portion 128B, so that channel 132, 141 and 152 form a continuous channel cavity.

An adhesive is disposed between the interior surfaces 140A, 140B, 140C of the outsole 128 and the outsole-facing surfaces 138A, 138B of the midsole 126 for fixedly securing the midsole 126 and the outsole 128 together in a fluid-tight manner. In this regard, as discussed above, it will be appreciated that the sole portion 126A of the midsole 126 and the second sole portion 128B of the outsole 128 are formed of fluid-impermeable materials and are also resilient to accommodate flexing during use of the shoe 120. Thus, the sole portion 126A of the midsole 126 and the second sole portion 128B of the outsole 128B cooperate to hermetically seal and form a metatarsal pocket 157, permanently trapping air or other fluid at atmospheric, or other pressure therein.

The outer sole and heel structure 124 also includes a bladder 158 and a hollow tube 160 defining a restricted passageway 162.

As seen in FIG. 9, the tube 160 and bladder 158 can be a one-piece molded construction made of a rubber-type material Which is expandable and impervious to fluid. The bladder 158 and tube 160 have air, or other fluid, at atmospheric or other pressure, trapped therein.

As seen in FIG. 8, the bladder 158 is disposed in the oval-shaped cavity 139 directly under a sock-liner 164 (and a wearer's foot). The tube 160 is disposed in and adhesively attached to the channel cavity 132 of the heel portion 126B of the midsole 126, the channel cavity 152 of the heel portion 128C of the outsole 128 and the channel cavity 141 of the second sole portion 128B of outsole 128.

As best seen in FIG. 8, restricted passageway 162 has a first opening 166 which opens into the metatarsal pocket 157 and a second opening 168 which opens into the bladder 158. The restricted passageway 162 thereby allows the metatarsal pocket 157 to fluidly communicate with the bladder 158.

As best seen in FIGS. 6, 8, and 9, since no portion of the bladder 158 projects from the exterior surface 142C of the heel portion 128C of the outsole 128, the exterior surface 142C of the heel portion 128C of the outsole 128 is generally flat and planar. This planarity allows the shoe 120 to have a heel 110 having a planar exterior surface 112 attached to the exterior surface 142 of the heel portion 128C of the outsole 128.

In use, the air in pocket 157 and bladder 158 provide a cushioning effect. In walking and running, the heel 110 first comes in contact with the ground and the heel of a wearer's foot exerts pressure on the sock-liner above the bladder 158 and the heel 110. The force of the ground contacting the heel 110 and the force of the wearer's heel on the sock-liner 164 directly above the bladder 158 causes the air to be compressed in the bladder 158 and forced through the passageway 162 into the metatarsal pocket 157. As the heel 110 lifts off the ground and the metatarsal bulge 148 contacts the ground, air in metatarsal pocket 157 is forced through passageway 162 back into bladder 158, which expands to give a lifting effect. Thus, during striding, such as walking and running, the air moves back and forth between the pocket 157 and the bladder 158 through the passageway 162 to give an alternating lifting effect and provide thrust both at the metatarsal ball area and in the heel area that facilitates walking and running.

The planarity of the heel 110 provides increased lateral stability as compared to a shoe which has a bulge (which forms a portion of a heel air pocket) which extends from the heel portion of an outsole and has no other means for aiding stability. For example, when the heel portion of such a shoe with a pocket strikes the ground, typically at the laterally outer side of heel, a portion of the air in the heel pocket will be forced laterally within the heel pocket, which might tend to cause a tilting or rocking of the wearer's foot. Since the exterior surface 112 of the heel 110 is flat and the bladder 158 is not disposed on the exterior surface 112, but is located within the interior of the outer sole and heel structure 124 and has a smaller volume than a pocket having a portion disposed on the exterior surface, this instability is minimized.

Due to the different forces exerted in use on the pocket 157 and the bladder 158, and for the same reasons as discussed above for the embodiment shown in FIGS. 1–5, the volume of the bladder 158, which has no portion in direct contact with the ground, is smaller than that of the pocket 157, which has a portion which does contact the ground. In this case, bladder 158 has a smaller volume than metatarsal pocket 157.

The present invention is also extremely useful with women's high heel shoes. Since the outer sole and heel members of the present invention do not require a bulge at the heel portion of an outsole, women's high heels are easily incorporated in a properly shaped outer sole and heel member.

Figure 11:
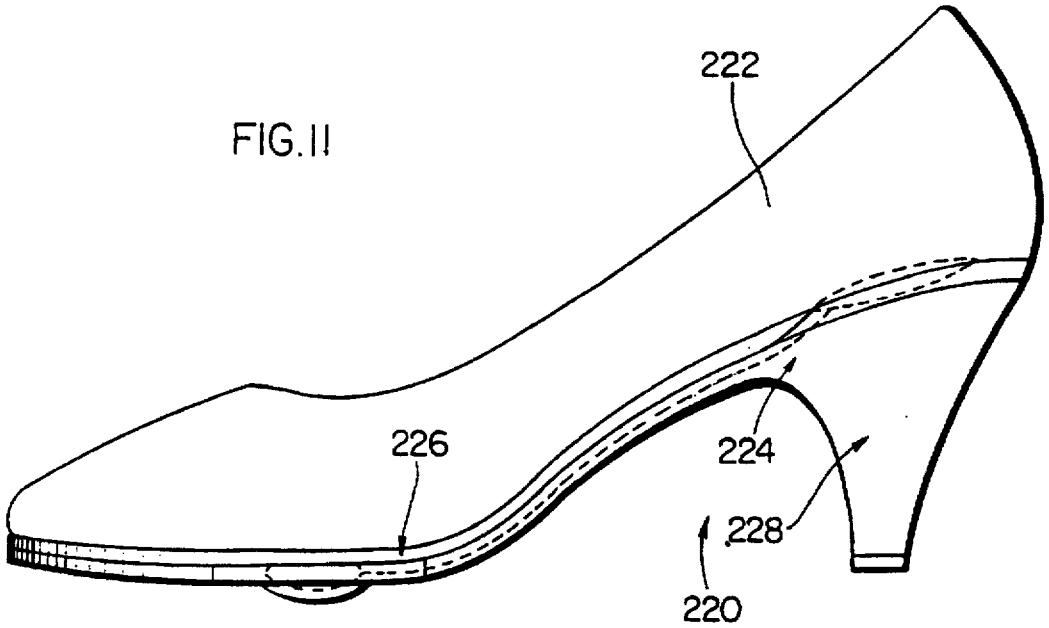
FIG. 11 is a side elevational view of a third shoe embodiment of the present invention.
Figure 12:
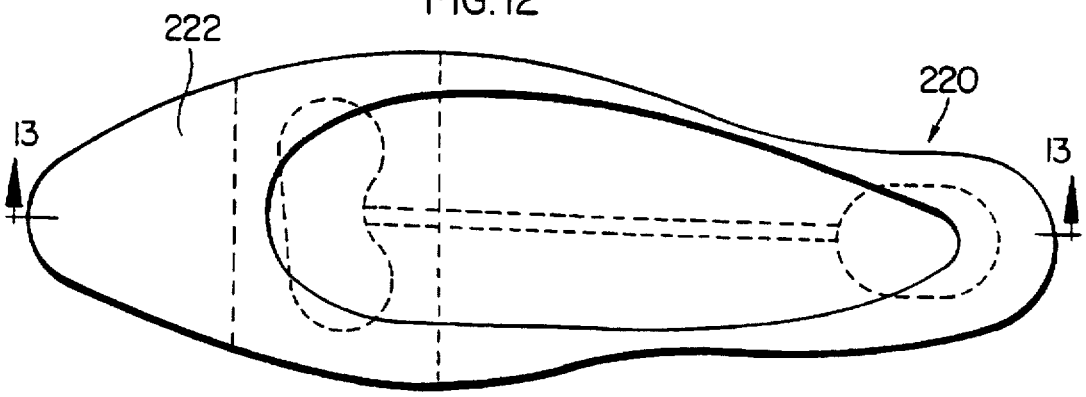
FIG. 12 is a top plan view of the shoe of FIG. 11.
Figure 13:
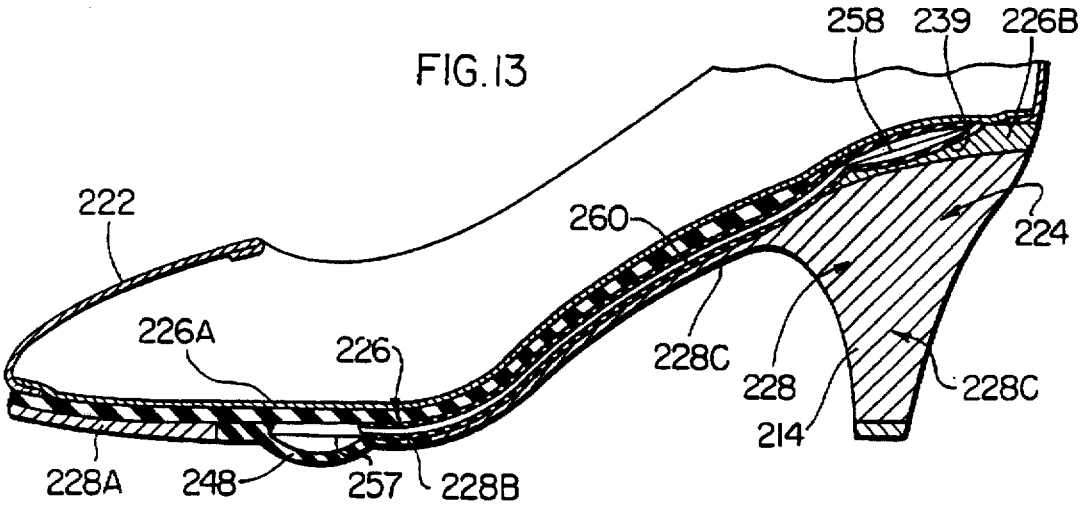
FIG. 13 is a fragmentary, sectional view taken generally along the line 13—13 of FIG. 12.

As seen in FIGS. 11–13, a women's high heel shoe 220 is provided. The shoe 220 includes an upper 222 and an outer sole and heel structure 224 which is similar to the outer sole and heel structure 124 of FIGS. 6–10.

Like the outer sole and heel structure 124 of FIGS. 6–10, the outer sole and heel structure 224 includes a two-piece midsole 226 having a sole portion 226A and a heel portion 226B and a three-piece outsole 228, including a first sole portion 228A, a second sole portion 228B (having a metatarsal bulge 248 defining a portion of a metatarsal pocket 257) and a heel portion 228C.

The heel portion 228C of the outsole 228 is however, different than the heel portion 128C of the outer sole and heel structure 124 of FIGS. 6–10. The heel portion 228C includes a high heel portion 214, which provides a wearer with added height.

The outer sole and heel structure 224 also includes an expandable bladder 258 disposed in a cavity 239 of the heel portion 226B of the midsole 226 and a tube 260 providing fluid communication between the bladder 258 and the metatarsal pocket 257 to provide cushioning and forward thrust for a wearer of the high heel shoe 220.

Figure 14:
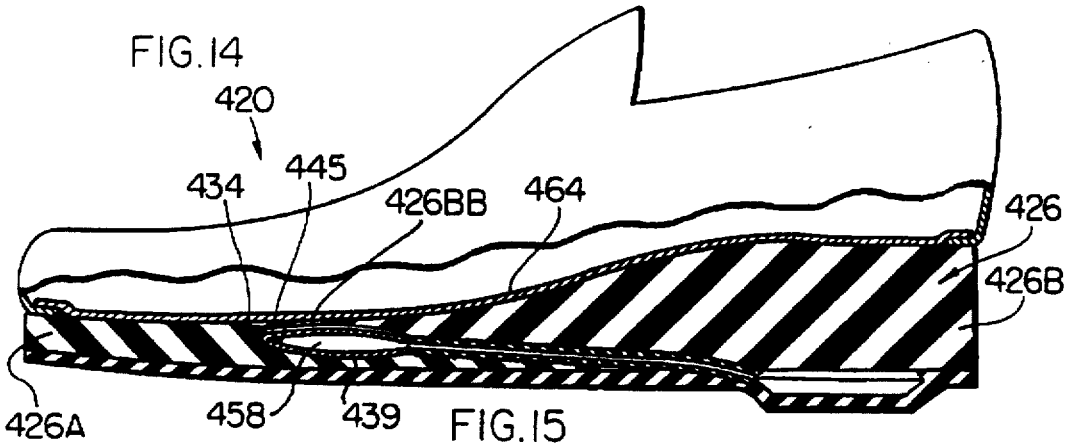
FIG. 14 is a side elevational view, in partial section, of a fourth shoe embodiment of the present invention.

As seen in FIG. 14, a fourth embodiment of the present invention is provided. A shoe 420 is provided which is substantially identical to the shoe 20 shown in FIGS. 1–5 except that the shoe 420 has a bladder 458 that is not disposed directly under a sock-liner. As seen in FIG. 14, the bladder 458 is disposed in an oval cavity 439 of a sole portion 426A of a midsole 426. A section 426BB of a heel portion 426B of the midsole 426 overlies the bladder 458 and is disposed between the bladder 458 and a sock-liner 464. The section 426BB has an oval-shaped cavity 445 opening at an inclined surface 434 of the heel portion 426B of the midsole 426 and disposed directly above the bladder 458. The cavity 445 provides space for the bladder 458 to expand to provide proper cushioning. If no cavity was provided, the bladder 458 would be in contact with the heel portion 426B of the midsole 426 and the bladder 458 could not fully expand.

Since the bladder 458 is not directly under the sock-liner 464, the sock-liner 464 is allowed to have a smooth surface in contact with a wearer's foot, rather than having a slightly elevated area under the metatarsal ball area of a wearer's foot, like the sock-liner 64 seen in FIG. 3, which might irritate the wearer's foot.

Figure 15:
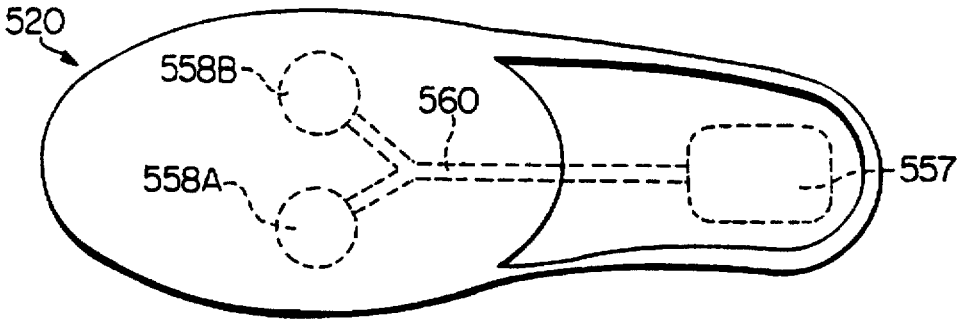
FIG. 15 is a top plan view of a fifth shoe embodiment of the present invention.

FIG. 15 illustrates a fifth embodiment of the present invention that also aids in preventing potential discomfort to the metatarsal ball area of a wearer's foot. As seen in FIG. 15, a shoe 520 substantially identical to the shoe 20 of FIGS. 1–5 is provided. The shoe 520 differs from shoe 20 in that two separated bladders 558A, 558B (rather than a single bladder) are disposed under the metatarsal ball area of a wearer's foot. These bladder 558A, 558B are connected to a Y-shaped tube 560 which provides fluid communication between the bladders 558A, 558B and a heel pocket 557.

Figure 16:
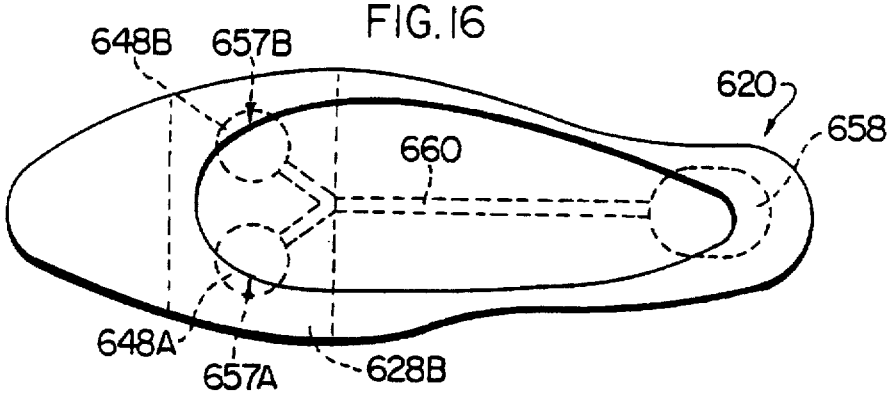
FIG. 16 is a top plan view of a sixth shoe embodiment of the present invention.

Similarly, a sixth embodiment of the present invention is illustrated in FIG. 16, which also aids in preventing discomfort to the metatarsal ball area of a user's foot. As seen in FIG. 16, a shoe 620 is provided which is substantially identical to the shoe 220 of FIGS. 11–13. Shoe 620 differs from shoe 220 in that a sole portion 628B has two separated metatarsal bulges 648A, 648B which define two separated metatarsal pockets 657A, 657B connected by a Y-shaped tube 660 which provides fluid communication between the metatarsal pockets 657A, 657B and a bladder 658 disposed in the heel portion of a midsole of the shoe 620.

Figure 17:
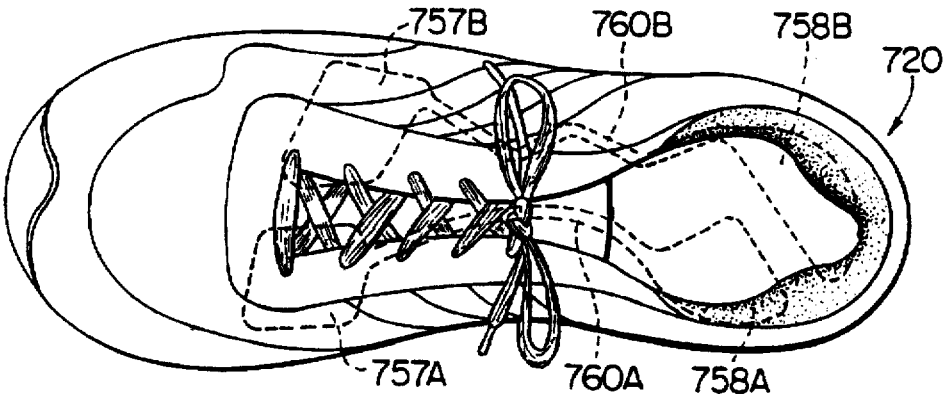
FIG. 17 is a top plan view of a seventh shoe embodiment of the present invention.

A seventh embodiment of the present invention is illustrated in FIG. 17. As seen in FIG. 17, a shoe 720, such as an athletic shoe, is provided which includes two separated fluid-containing metatarsal pockets 757A, 757B and two separated fluid-containing heel pockets 758A, 758B. Metatarsal pockets 757A, 757B are disposed under the metatarsal ball area of a wearer's foot and heel pockets 758A, 758B are disposed under the heel area of wearer's foot. Metatarsal pocket 757A is fluidly connected to heel pocket 758A by an arcuate-shaped tube 760A. Metatarsal pocket 757B is fluidly connected by a zig-zag shaped tube 760B to heel pocket 758B. Metatarsal pockets 757A, 757B can each be formed of an expandable bladder in the midsole or defined by bulges projecting from the exterior surface of the outsole. Likewise, heel pockets 758A, 758B can each be formed of an expandable bladder in the midsole or defined by bulges projecting from the exterior surface of the outsole. If metatarsal pockets 757A, 757B are formed of expandable bladders, then heel pockets 758A, 758B are defined by bulges projecting from the outsole. If metatarsal pockets 757A, 757B are defined by bulges projecting from the outsole, then heel pockets 758A, 758B are formed from expandable bladders. Since metatarsal pocket 757A is separated from metatarsal pocket 757B and since heel pocket 757A is separated from heel pocket 757B, there is little, if any, side to side movement of fluid which can cause instability. This prevention of instability is discussed in greater detail in both U.S. Pat. Nos. 5,375,346 and 5,416,986, the disclosures of which are incorporated herein by reference.

While particular embodiments of the present invention have been shown and described, it will be appreciated by those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

We claim:

1. A shoe sole and heel construction comprising:

a structure having an exterior ground-contacting surface and a bulge projecting from the exterior ground-contacting surface, the bulge defining a first pocket;

an expandable bladder defining a second pocket and disposed in the structure above the exterior ground-contacting surface to avoid contact with the ground in use;

the structure including a portion defining a passageway providing fluid communication between the pockets; and fluid permanently disposed in the space jointly defined by the pockets and the passageway;

whereby at rest a foot in a shoe incorporating the structure is cushioned comfortably on the fluid in the first and second pockets.

2. The construction of claim 1, wherein the structure includes a heel portion and a sole portion, and one of the pockets is disposed in the sole portion and the other is disposed in the heel portion;

whereby at rest a foot in a shoe incorporating the structure is cushioned comfortably on the fluid in the pockets and during striding such fluid moves through the passageway between the pockets so as to provide shock absorption and an alternating lifting effect by the pockets which provide forward thrust both in the heel portion and the sole portion that facilitates moving.

3. The construction of claim 2, wherein the first pocket is disposed in the sole portion and underlies the metatarsal ball area of a foot for which the structure is sized and the second pocket is disposed in the heel portion and underlies the heel area of the foot.

4. The construction of claim 2, wherein the second pocket is disposed in the sole portion and underlies the metatarsal ball area of a foot for which the structure is sized and the first pocket is disposed in the heel portion and underlies the heel area of the foot.

5. A shoe sole and heel structure comprising:

an outsole having interior and exterior surfaces and a bulge projecting from the exterior surface, the bulge defining a cavity opening at the interior surface;

a midsole overlying the outsole, the midsole having an outsole-facing surface and a foot-facing surface;

means for hermetically attaching the interior surface of the outsole to the outsole-facing surface of the midsole to form a member having a sole portion and a heel portion, wherein the cavity cooperates with a portion of the midsole to define a pocket;

an expandable bladder disposed above said exterior surface of said outsole;

a tube defining a passageway in the member providing fluid communication between the pocket and the bladder; and fluid permanently disposed in the space jointly defined by the pocket, the bladder and the passageway;

whereby at rest a foot in a shoe incorporating the structure is cushioned comfortably on the fluid in the pocket and the bladder.

6. The structure of claim 5, wherein one of the pocket and the bladder is disposed in the sole portion and the other is disposed in the heel portion;

whereby at rest a foot in a shoe incorporating the structure is cushioned comfortably on the fluid in the pocket and the bladder and during striding such fluid moves through the passageway between the pockets and the bladder so as to provide shock absorption and an alternating lifting effect by the pocket and the bladder which provide forward thrust both in the heel portion and the sole portion that facilitates moving.

7. The structure of claim 6, wherein the midsole has a cavity opening at the foot facing surface and the bladder is disposed therein.

8. The structure of claim 7, wherein the pocket is disposed in the sole portion and underlies the metatarsal ball area of a foot for which the structure is sized and wherein the bladder is disposed in the heel portion and underlies the heel area of the foot.

9. The structure of claim 8, wherein the outsole includes first and second sole pieces disposed in the sole portion and a heel piece, the second sole piece being disposed under the metatarsal ball area of the foot and having the bulge disposed therein.

10. The structure of claim 7, wherein the bladder is disposed in the sole portion and underlies the metatarsal ball area of a foot for which the structure is sized and wherein the pocket is disposed in the heel portion and underlies the heel area of the foot.

11. The structure of claim 10, wherein the outsole is of one-piece construction.

12. The structure of claim 5, wherein the tube is integral with the bladder and the tube and bladder are a one-piece molded construction.

13. The structure of claim 5, wherein the midsole includes first and second portions respectively having first and second opposed surfaces and wherein the first portion has a channel cavity opening at the first opposed surface, and a portion of the passageway is disposed in the channel cavity.

14. The structure of claim 6, wherein the pocket and the bladder respectively have first and second volumes, and the second volume is less than the first volume.

15. A shoe comprising:

a foot-receiving upper and a sole and heel structure secured to the upper;

the structure including an outsole having interior and exterior surfaces and a bulge projecting from the exterior surface, the bulge defining a cavity opening at the interior surface;

a midsole overlying the outsole, the midsole having an outsole-facing surface and a foot-facing surface;

an expandable bladder disposed above said exterior surface of said outsole ;

means for hermetically attaching the interior surface of the outsole to the outsole-facing surface of the midsole to form a member having a sole portion and a heel portion, wherein the cavity cooperates with a portion of the midsole to define a pocket;

a tube defining a passageway in the member providing fluid communication between the pocket and bladder; and fluid permanently disposed in the space jointly defined by the pocket, the bladder and the passageway;

whereby at rest a foot in the shoe is cushioned comfortably on the fluid in the pocket and the bladder.

16. The shoe of claim 15, wherein one of the pocket and the bladder is disposed in the sole portion and the other is disposed in the heel portion, whereby during striding the fluid moves through the passageway between the pocket and the bladder so as to provide shock absorption and an alternating lifting effect by the pocket and bladder which provide forward thrust both in the heel portion and the sole portion that facilitates moving.

17. The shoe of claim 16, wherein the pocket is disposed in the sole portion and underlies the metatarsal ball area of a foot for which the shoe is sized and wherein the bladder is disposed in the heel portion and underlies the heel area of the foot.

18. The shoe of claim 17, and further comprising a heel disposed at the heel portion and attached to the exterior surface of the outsole.

19. The shoe of claim 16, wherein the bladder is disposed in the sole portion and underlies only the metatarsal ball area of a foot for which the shoe is sized and wherein the pocket is disposed in the heel portion underlies the heel area of the foot.

20. The shoe of claim 16, wherein the midsole has a cavity opening at the foot facing surface and the bladder is disposed therein.

21. The structure of claim 6, wherein the bladder is disposed between the outsole-facing surface and the foot-facing surface of the midsole.

22. The structure of claim 21, wherein the midsole includes first and second portions respectively having first and second opposed surfaces, wherein the bladder is disposed between the first and second opposed surfaces.

* * * * *